United States Patent [19]

Montgomery et al.

[11] Patent Number: 4,507,957

[45] Date of Patent: Apr. 2, 1985

[54] APPARATUS FOR TESTING EARTH FORMATIONS

[75] Inventors: Marshall N. Montgomery; John M. Michaels, both of Houston, Tex.

[73] Assignee: Dresser Industries, Inc., Dallas, Tex.

[21] Appl. No.: 495,313

[22] Filed: May 16, 1983

[51] Int. Cl.[3] ..... E21B 49/10; E21B 47/00

[52] U.S. Cl. ..... 73/151; 166/100

[58] Field of Search ..... 73/155; 166/100

[56] References Cited

U.S. PATENT DOCUMENTS

| | | | |
|---|---|---|---|
| 3,011,554 | 12/1961 | Desbrandes et al. | 166/100 |
| 3,022,826 | 2/1962 | Kisling | 166/100 |
| 3,104,712 | 9/1963 | Whitten | 166/100 |
| 3,653,436 | 4/1972 | Anderson et al. | 166/100 |
| 3,780,575 | 12/1973 | Urbanosky | 73/152 |
| 3,782,191 | 1/1974 | Whitten | 166/100 |
| 4,210,018 | 7/1980 | Brieger | 166/100 |
| 4,416,152 | 11/1983 | Wilson | 73/155 |
| 4,434,653 | 3/1984 | Montgomery | 73/155 |

*Primary Examiner*—Howard A. Birmiel
*Attorney, Agent, or Firm*—Patrick H. McCollum; Richard M. Byron

[57] ABSTRACT

Apparatus is provided for collecting a plurality of samples of fluids in earth formations traversed by a well bore. The sampling apparatus includes an elongated body member adapted to carry an extensible and retractible fluid admitting probe which is selectively placed in sealing engagement with potentially producible earth formations. The fluid admitting probe is coupled to a fluid passage which is selectively placed into fluid communication with a fluid sample collection chamber. A selectively controllable pressure control system located in the fluid passage intermediate the fluid admitting probe and the sample collection chamber allows the flowing pressure within the formation fluid sample line to be maintained at any selected pressure level functionally related to hydrostatic pressure during fluid sample collection.

16 Claims, 6 Drawing Figures

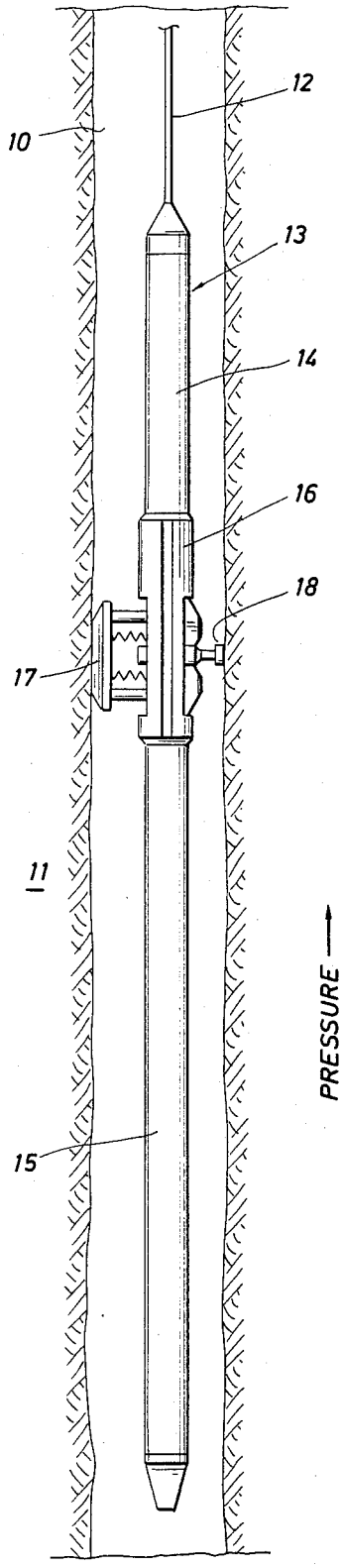
FIG. 1
FIG. 3
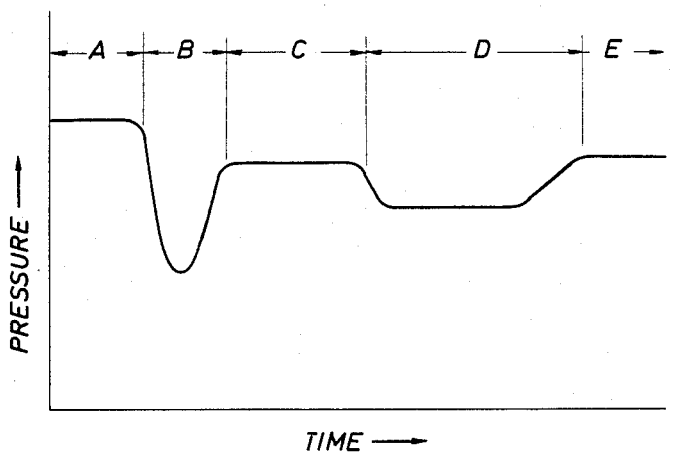

APPARATUS FOR TESTING EARTH FORMATIONS

RELATED CASES

This application is related to copending application Ser. No. 398,477, filed July 15, 1982, now U.S. Pat. No. 4,434,653.

BACKGROUND OF THE INVENTION

This invention relates, in general, to fluid samplers, and more particularly to apparatus for performing non-destructive collection of fluid samples from subsurface earth formations traversed by a borehole.

The sampling of fluids contained in subsurface earth formations provides a method of testing formation zones of possible interest by recovering a sample of any formation fluids present for later analysis at the earth's surface while causing a minimum of damage to the tested formations. Thus, the formation sampler is essentially a point test of the possible producibility of subsurface earth formations. Additionally, a continuous record of the sequence of events during the test is made at the surface. From this record valuable formation pressure and permeability data can be obtained for formation reservoir analysis.

Early formation fluid sampling instruments, such as the one described in U.S. Pat. No. 2,674,313, were not fully successful as a commercial service because they were limited to a single test on each trip into the borehole. Later instruments were suitable for multiple testing; however, the success of these testers depended to some extent on the characteristics of the particular formations to be tested. For example, where earth formations were unconsolidated a different sampling apparatus was required than in the case of consolidated formations.

One major problem which has hampered the reliable testing of subsurface earth formations has been in designing a suitable system for preventing seal loss between an extensible packer element of the formation tester instrument and the formation at the initiation and during fluid sample collection. This problem is particularly acute in highly unconsolidated formations. A related problem has been in designing a system for eliminating the sudden pressure drop within the formation fluid sample line when the control valve controlling the fluid sample collection tank is opened. This sudden pressure drop can result in degeneration of the formation in the packer area causing a loss of seal between the packer and the formation resulting in contamination of the formation fluid sample.

In an effort to control the rate of fluid sample intake, and thus reduce the chances of packer seal loss, U.S. Pat. No. 3,022,826, issued to Kisling III, attempts to overcome the problem by employing a flexible bag member as a fluid sample collection chamber and by pressure balancing the flexible bag to reduce the rate of fluid sample intake. Another technique for controlling the rate of fluid sample intake can be found in U.S. Pat. No. 3,653,436, issued to Anderson et al, which continuously employs formation pressure to slidably move a flow restricting cover from a position within the sample intake probe. As the flow restricting cover moves rearward within the probe a filter screen is gradually exposed allowing formation fluid flow into a sample collection tank. Yet another system for controlling initial flow rate is disclosed in U.S. Pat. No. 3,780,575, issued to Urbanosky, where the flow restriction is controlled by a pressure ratio of borehole pressure to formation pressure, rather than simply based on formation pressure, as in Anderson et al. While these designs represent improvements, usage has shown them to be less than totally successful particularly in highly unconsolidated formations.

Accordingly, the present invention overcomes the deficiencies of the prior art by providng method and apparatus for obtaining a plurality of formation fluid samples under adverse formation conditions in a single traversal of the borehole.

SUMMARY OF THE INVENTION

Apparatus for obtaining a plurality of formation fluid samples according to the present invention includes fluid admitting member adapted for establishing fluid communication between earth formations and a fluid sampling and measuring instrument. The fluid admiting member is telescopically extensible from the instrument into sealing engagement with potentially producible earth formations. A central tubular member coaxially disposed within a sealing member extends, penetrating any mud cakes and extending into the earth formations. When the fluid admitting member is fully extended a pre-test sample is taken through a bore located in the fluid admitting member. The pre-testing operation serves to pull any mud cakes and earth particles into the bore exposing to any formation fluids present a plurality of coaxially located passages within the fluid admitting member. Prior to extending the fluid admitting member a sample pressure control valve is activated thereby capturing a sample of fluid at hydrostatic pressure. The captured fluid at hydrostatic pressure is used to bias a valve seal within a selectively controllable sample pressure control valve. Upon activation of a sample chamber control valve any collectable formation fluids present must overcome the pressure bias provided by the sample pressure control valve before fluid communication is established between the earth formations and the sample collection line. The bias pressure is selectively controllable so that it may be adjusted to any suitable level during formation fluid sample collection. Upon completion of the sampling operation a sample chamber lock valve is activated trapping the formation fluid sample within the chamber and the pre-test sample is expelled through the collection member dislodging any mud cakes or earth formation particles contained in the central bore and the instrument is either relocated within the borehole for taking additional samples or is returned to the earth's surface where the collected samples can be analyzed.

BRIEF DESCRIPTION OF THE DRAWINGS

FIG. 1 is a pictorial view, partly in crosssection, of a formation testing instrument disposed in a borehole.

FIG. 3 graphically illustrates a typical pressure verses time relationship as measured by a fluid sample pressure transducer of the formation testing instrument.

DETAILED DESCRIPTION OF THE PREFERRED EMBODIMENT

Figure 2A:
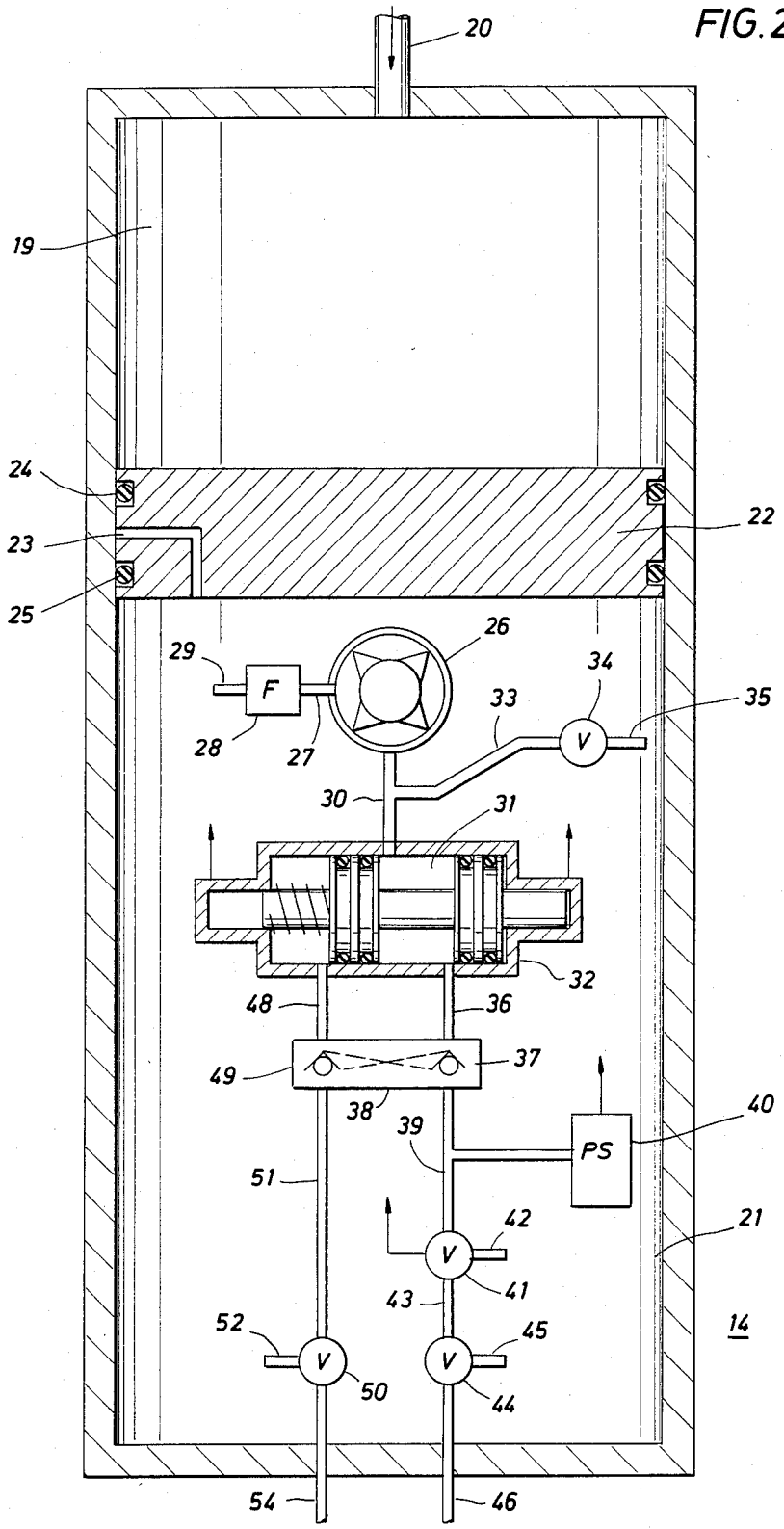
FIG. 2A–2D together show a somewhat-schematic representation of the formation testing instrument illustrated in FIG. 1.
Figure 2B:
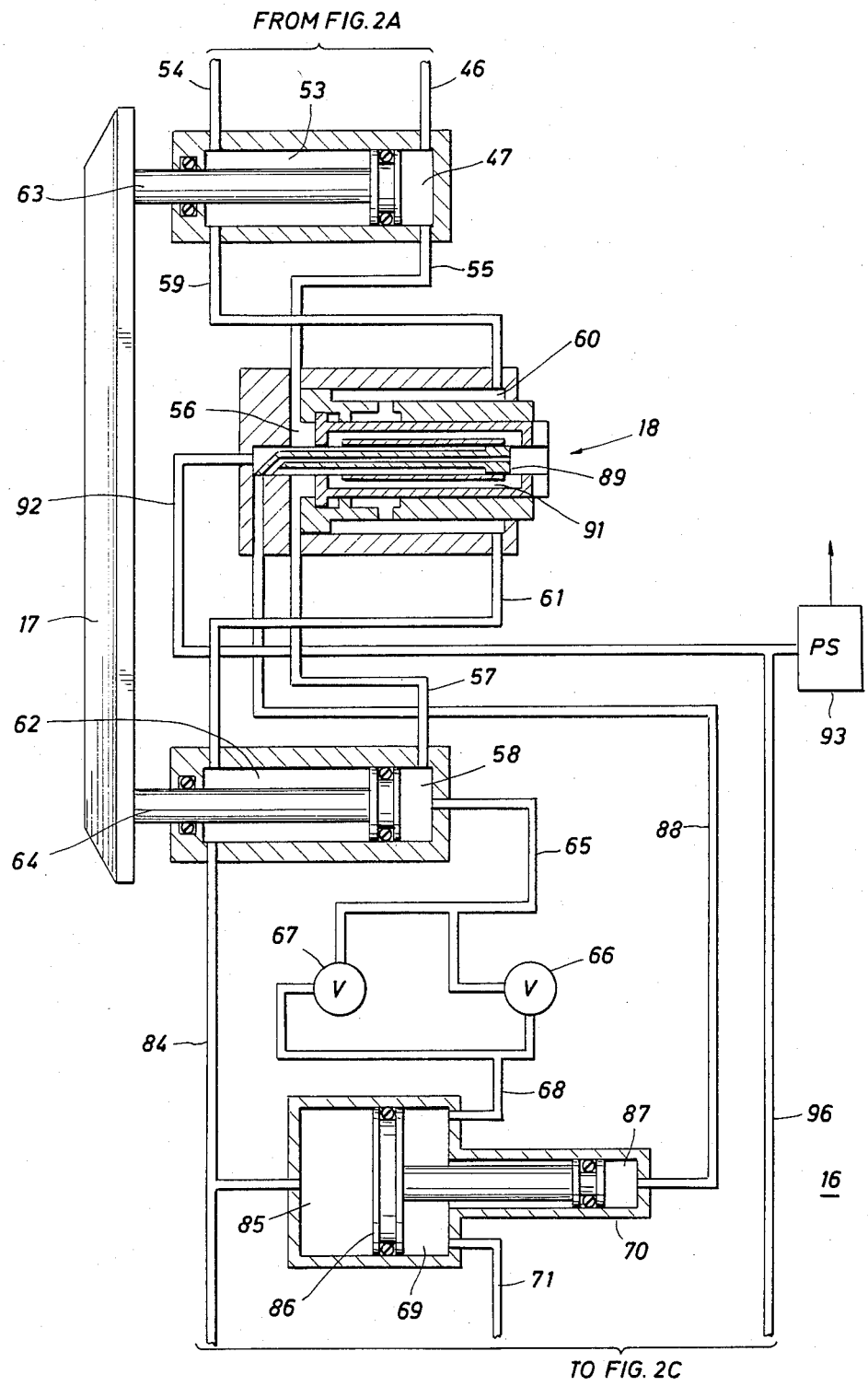
Figure 2C:
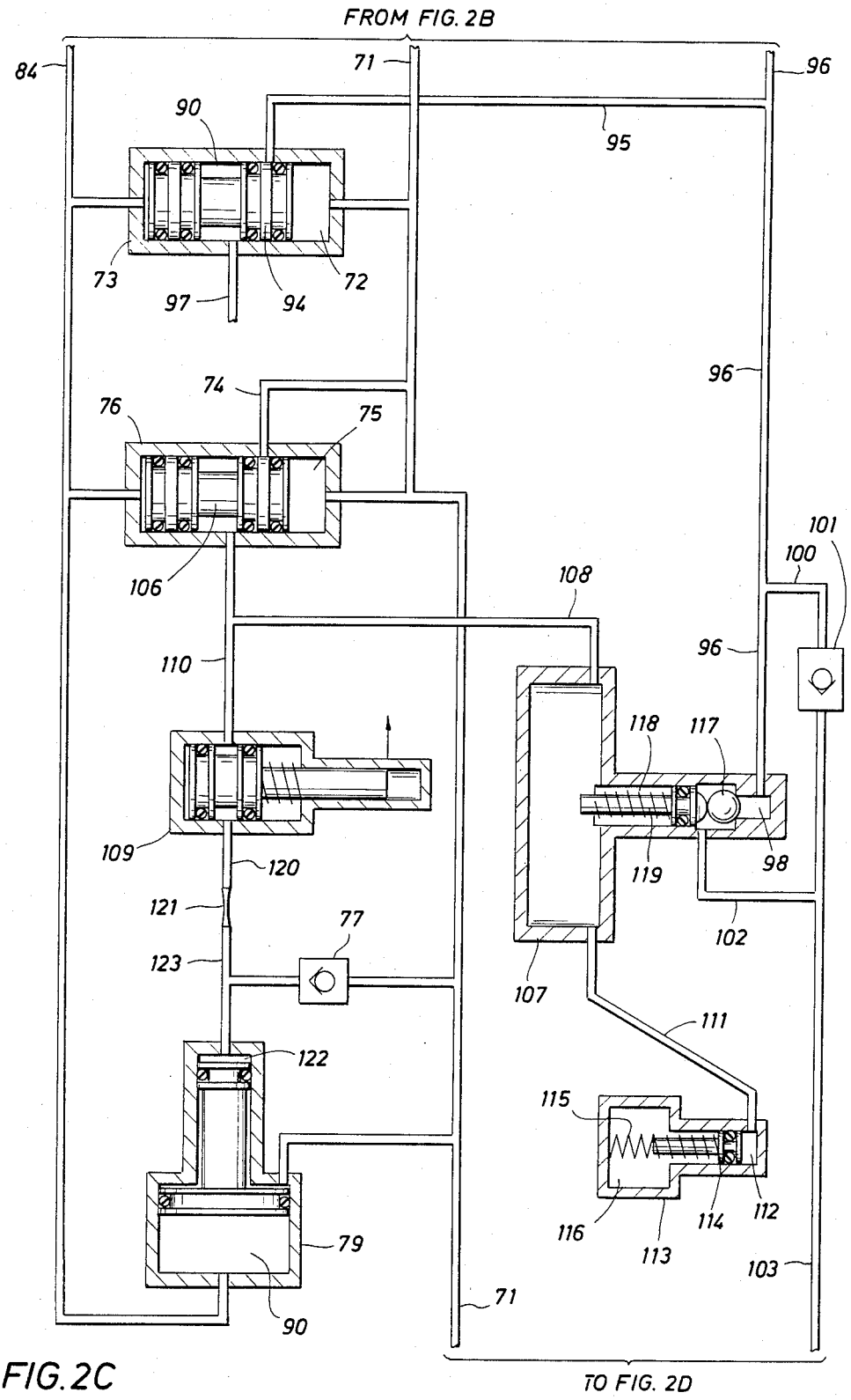

Referring now to the drawings in more detail, especially to FIG. 1, there is illustrated schematically a section of a borehole 10 penetrating a portion of the earth formations 11, shown in vertical section. Disposed within the borehole 10 by means of a cable or wireline 12 is a sampling and measuring instrument 13. The sample and measuring instrument 13 is comprised of a hydraulic power system section 14, a fluid sample storage section 15, and a sampling mechanism section 16. Sample mechanism section 16 includes selectively extensible well engaging pad member 17 and a selectively extensible fluid admitting member 18.

In operation, sampling and measuring instrument 13 is positioned within borehole 10 by means of cable 12 being wound on or unwound from a drum (not shown) located at the earth's surface. When sampling and measuring instrument 13 is disposed adjacent an earth formation of interest electrical control signals are transmitted through electrical conductors contained within cable 12 from a surface electronic assembly (not shown) to sampling and measuring instrument 13. These electrical control signals activage the hydraulic power system section 14 causing the well engaging pad member 17 and the fluid admitting member 18 to move laterally from sampling and measuring instrument 13 into engagement with 13 into engagement with the earth formations 11. Fluid admitting member 18 can then be placed in fluid communication with the earth formation 11 allowing for taking of a sample of any producible connate fluids contained in the earth formations.

Referring now to FIG. 2A through 2D, there is illustrated a somewhat-schematic representation of the hydraulic power system section 14, the sampling mechanism section section 16 and the fluid sample storage section 15 of sampling and measuring instrument 13. The hydraulic power system section 14 includes an upper borehole fluid chamber 19, which is in fluid communication with the borehole through passage 20, and a lower hydraulic fluid chamber 21, which contains a hydraulic fluid such as oil or the like. Disposed between the upper borehole fluid chamber 19 and the lower hydraulic fluid chamber 21 is a free-floating isolation piston 22. Isolation piston 22 serves to not only isolate the upper borehole fluid chamber 19 from the lower hydraulic fluid chamber 21 but also maintains the hydraulic fluid within the hydraulic fluid chamber 21 at a pressure about equal to the hydrostatic pressure at whatever depth the tool is situated in the borehole, as well as for accommodating for volumetric changes in the hydraulic fluid which may occur under various borehole conditions. A passage 23 is provided within piston 22 from hydraulic fluid reservoir 21 to the outside periphery of isolation piston 22 between o-rings 24 and 25 to prevent pressure locking of the isolation piston 22.

Since sampling and measuring instrument 13 is to be operated at great depths within boreholes which can contain dirty and unusually corrosive fluids, housed within the protection of hydraulic fluid chamber 21 is hydraulic pump 26, which in the preferred embodiment is an electrically powered, rotary, positive-displacement type hydraulic pump. Hydraulic pump 26 has a first hydraulic line or conduit 27 connecting to fluid filter 28 which further communicates with lower hydraulic fluid chamber 21 by hydraulic line 29. A second hydraulic line 30 connects hydraulic pump 26 with fluid chamber 31 within valve assembly 32. Valve assembly 32 can comprise any suitable dual-position electrically controllable hydraulic valve, for example, such such as Model NWE-5-N/6.0/OF-22V60NZ4V, sold by Rothrex, Inc. Branchingly connected to hydraulic line 30 is hydraulic line 33 which connects to pressure regulating valve 34 which further communicates with hydraulic fluid chamber 21 through hydraulic line 35.

Fluid chamber 31 of valve assembly 32, in the valve position shown, connnects through hydraulic line 36 to a first check valve section 37 of duel pilot check valve 38. The output of first check valve section 37 is branchingly coupled through hydraulic line 39 to hydraulic fluid pressure sensor 40 and to electrically controllable dump valve 41. Dump valve 41 communicates with hydraulic fluid chamber 21 through hydraulic line 42. A second hydraulic line 43 from dump valve 41 connects to relief valve 44. From relief valve 44 a first hydraulic line 45 communicates with hydraulic fluid chamber 21 and a second hydraulic line 46 connects to well engaging member extender chamber 47.

A third hydraulic line 48 connects from valve assembly 32 to a second check valve section 49 of dual pilot check valve 38. The output of second check valve section 49 connects to relief valve 50 by hydraulic line 51. Relief valve 50 connects to hydraulic fluid chamber 21 through hydraulic line 52 and connects to well engaging member piston retractor chamber 53 through hydraulic line 54.

Well engaging member piston extender chamber 47 is coupled through hydraulic line 55 to fluid admitting member extender chamber 56 which is further coupled through hydraulic line 57 to well engaging member piston extender chamber 58. Well engaging member piston retractor chamber 53 is coupled through hydraulic line 59 to fluid admitting member retractor chamber 60 which is further coupled through hydraulic line 61 to well engaging member piston retractor chamber 62. Well engaging pad member pistons 63 and 64 are a longitudinally spaced pair of laterally movable pistons arranged traversely on the body of sampling and measuring instrument 13. Pistons 63 and 64 are arranged to provide contemporaneous expansion of well engaging pad member 17 and fluid admitting member 18. Conversely, pistons 63 and 64 cooperate to provide contemporaneous retraction of well engaging pad member 17 and fluid admitting member 18.

Piston extender chamber 58 couples to hydraulic line 65 which branchingly couples to relief valve 66 and check valve 67. Relief valve 66 and check valve 67 are coupled through hydraulic line 68 to fluid chamber 69 within pre-test sample assembly 70. Fluid chamber 69 is branchingly coupled through hydraulic line 71 to fluid chamber 72 of equalizer valve 73, hydraulic branch line 74, fluid chamber 75 of divider valve 76, one side of check valve 77, fluid chamber 78 of valve 79, solenoid valve 80, solenoid valve 81, solenoid valve 82 and solenoid valve 83. Solenoid valves 80-83 can be any suitable electrically controllable hydraulic control valves, such as those sold by ATKOMATIC VALVE COMPANY, under part number 15-885. These valves are controlled by an electrical command and switching system known in the art, such as the system described in U.S. Pat. No. 3,780,575, which is incorporated herein by reference.

Piston retractor chamber 62 is coupled through hydraulic line 84 to fluid chamber 85 within pre-test sample assembly 70. Fluid chamber 69 and fluid chamber 85 are fluidly isolated from one another by displacement piston 86. Pre-test sample assembly 70 includes an expansible pre-test fluid sample chamber 87 coupled through fluid line 88 to a central bore 89 within fluid admitting member 18. In the preferred embodiment, pre-test fluid sample chamber is designated to hold a relative small amount of formation fluids such as a volume from between 10 cc to 20 cc. Hydraulic line 84 further branchingly couples to equalizer valve 73, divider valve 76 and fluid chamber 90 of valve 79.

Fluid admitting member 18 is provided with second coaxial passages 91 connecting to fluid line 92 which branchingly connects to formation pressure sensor 93, and fluid chamber 90 within equalizer valve 73, by branch line 95 of line 96. Additionally, fluid chamber 90 of equalizer valve 73 can be placed in fluid communication with the borehole by conduit 97. Fluid line 96 connects to cavity 98 of pressure restrictor valve 99. Fluid line 100 branches from fluid line 96 providing fluid communication to one side of check valve 101. Cavity 98 is connected through fluid line 102 to the second side of check valve 101 and by fluid line 103 to fluid chamber 104 within first sample storage tank control valve 105. Additionally, fluid chamber 106 of divider valve 76 is fluidly coupled to fluid chamber 107 of pressure restrictor valve 99 by fluid line 108 and to solenoid valve 109 by branch line 110. Fluid chamber 107 is further connected through fluid line 111 to fluid chamber 112 of balance valve 113 of the sample pressure control system. Disposed within fluid chamber 112 is slidably piston 114 biased into the illustrated position by a combination of spring 115 and atmospheric pressure trapped within chamber 116.

Briefly returning to pressure restrictor valve 99 of the sample pressure control system, disposed within fluid chamber 98 is ball seat 117. In the position illustrated ball seat 117 is biased into sealing position, isolating fluid chamber 98 into two sections and thereby isolating input fluid line 96 from output fluid line 102. Ball seat 117 is biased into the illustrated position by a combination of spring bias provided by spring 118 exerting force on slidable plunger 119 and by fluid pressure exerted on slidable plunger 119 from any pressurized fluid within fluid chamber 107.

As previously stated divider valve 76 is coupled by hydraulic line 110 to solenoid valve 109 which is an electrically controllable valve of the type previously mentioned. Solenoid valve 109 is coupled by hydraulic line 120 to flow restrictor 121 which is branchingly connected to check valve 77 and fluid chamber 122 of valve 79 by hydraulic line 123.

Figure 2D:
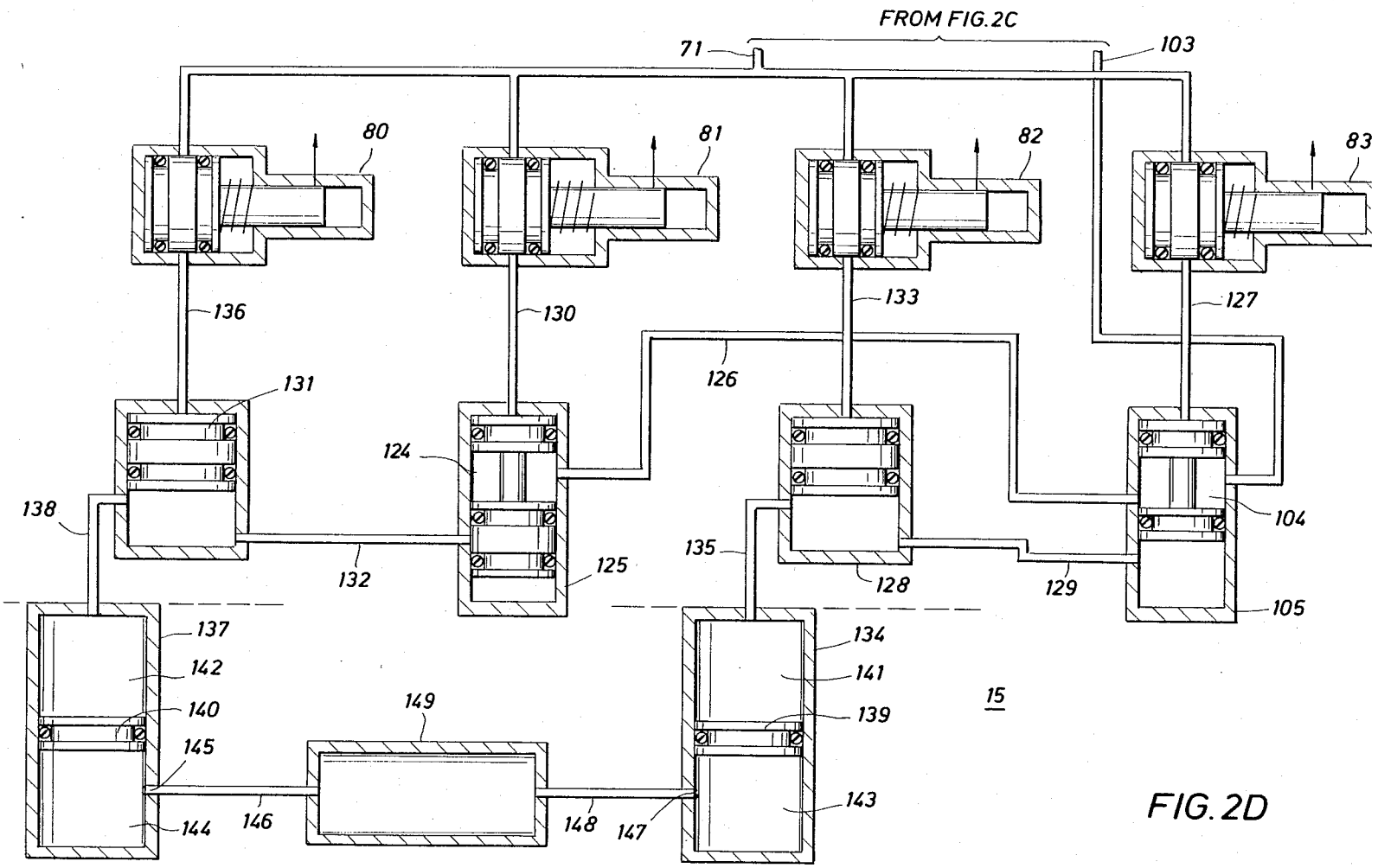

Turning now to FIG. 2D, fluid chamber 104 of first sample storage tank control valve 105 connects to fluid chamber 124 within second sample storage tank control valve 125 by fluid line 126. First sample storage tank control valve 105 connects to solenoid valve 83 by hydraulic line 127 and connects to first sample storage tank lock valve 128 by fluid line 129. Second sample storage tank control valve 125 connects to solenoid valve 81 by hydraulic line 130 and connects to second sample storage tank lock valve 131 by hydraulic line 132. First sample storage tank valve 128 couples to solenoid valve 82 by hydraulic line 133 and couples to the first sample storage tank 134 by fluid line 135. Second sample storage tank lock valve 131 couples to solenoid valve 80 by hydraulic line 136 and couples to the the second sample storage tank 137 by fluid line 138. Sample storage tanks 134 and 137 are divided into two separate fluid cavities by floating pistons 139 and 140, respectively. The upper chamber of tank 134 comprises a fluid sample storage chamber 141 with the upper chamber of tank 137 forming a second fluid sample storage chamber 142. Lower chamber 143 of tank 134 and the lower chamber 144 of tank 137 comprise water reservoirs. Water reservoirs 144 and 143 are respectively coupled through flow control orifice 145 and water line 146, and flow control orifice 147 and water line 148 to water cushion storage tank 149.

In the operating of the sampling and measuring instrument of FIG. 2, instrument 13, is positioned within a borehole opposite earth formations to be tested. Borehole mud and fluids enter borehole fluid chamber 19 by passage 20 which communicates with the borehole 10. The weight of the borehole fluid column is exerted as hydrostatic pressure within borehole fluid chamber 19, with this hydrostatic pressure acting on isolation piston 22 to produce counterbalancing pressure in the hydraulic fluid of the power system. As the sampling and measuring instrument 13 is is lowered into the borehole, the hydrostatic pressure increases and forces isolation piston 22 to move downward towards sampling mechanism section 16. The movement of piston 22 compresses the volume of the hydraulic fluid chamber 21, causing a corresponding increase in fluid pressure throughout the hydraulic system. Isolation piston 22 movement stops when the hydraulic system fluid pressure reaches a value approximately equaling the hydrostatic pressure. To prevent pressure locking of isolation piston 22, passage 23 supplies hydraulic fluid from hydraulic fluid reservoir 21 to the outside pheriphery of isolation piston 22, between o-ring seals 24 and 25.

When sampling and measuring instrument 13 is positioned within a borehole at a desired sampling location, energizing voltages from an electrical command unit (not shown) are supplied to motor driven hydraulic pump 26, valve assembly 32 and spring loaded dump valve 41. These command signals shift and hold the piston within fluid chamber 31 of valve assembly 32 to the pump forward (PF) position, as illustrated by the position of the piston in FIG. 2A; activates motor driven hydraulic pump 26; and maintains dump valve 41 in a de-energized position. The rotation of hydraulic pump 26 draws hydraulic fluid from hydraulic fluid reservoir 21 through hydraulic line 29, filter 28, hydraulic line 27 and into hydraulic pump 26 being further pumped through hydraulic line 30 into fluid chamber 31 of valve assembly 32. Hydraulic fluid is pumped also from hydraulic line 30 into branch hydraulic line 33 to pressure regulating valve 34. Pressure regulating valve 34 allows hydraulic fluid pressure flow to peak from preferable between 1700 psi and 1750 psi before unseating and opening a return path through hydraulic line 35 to hydraulic fluid chamber 21.

The PF hydraulic fluid flow travels from fluid chamber 31 through hydraulic line 36 to first check valve section 37 of dual pilot check valve 38. First check valve section 37 allows hydraulic fluid flow therethrough while pressure biasing second check valve section 49 of dual pilot check valve 38 in a closed position. Hydraulic fluid flow travels through hydraulic line 39 to dump valve 41 and through a branch hydraulic line to hydraulic fluid pressure sensor 40. Hydraulic fluid pressure sensor 40 is preferably a Bourdon pressure gage which converts the hydraulic fluid pressure into an electrical signal which is transmitted to the surface electronic section (not shown). The PF hydraulic fluid flow moves through dump valve 42 and hydraulic line 43 to relief valve 44. Relief valve 44 is preset at a pressure level slightly higher than that at pressure regulating valve 34 to allow hydraulic fluid flow to return through hydraulic line 45 into hydraulic fluid chamber 21. Preferably, relief valve 44 is set to unseat from between 2500 psi and 2550 psi. PF hydraulic fluid flow moves through relief valve 44, through hydraulic line 46 into piston extender chamber 47, further passing through hydraulic line 55 into a fluid admitting member extender chamber 56, continuing through hydraulic line 57 into piston extender chamber 58. The output signal from hydraulic fluid pressure sensor 40 increases as the hydraulic fluid pressure surge forces pistons 63 and 64 to move well engaging pad member 17 laterally in relation to the longitudinal axis of the instrument into contact with the well of the borehole. Contemporaneous with the lateral extension of well engaging pad member 17, the PF hydraulic fluid pressure within fluid admitting member extender chamber 56 extends the components of the fluid admitting member 18 in a telescoping manner forcing the leading portion of fluid admitting member through any mud cakes present and into fluid communication with the earth formations. A more complete description of fluid admitting member 18 can be found in U.S. patent application, Ser. No. 310,249, which is incorporated herein by reference.

When the PF hydraulic fluid flow pressure reaches a predetermined value, such as, for example, 2000 psi, relief valve 66 unseats, passing hydraulic fluid flow through hydraulic line 68 into fluid chamber 69 of pre-test sample assembly 70, moving displacement piston 86 rearward within pre-test sample assembly 70. The rearward movement of displacement piston 86 causes any mud cakes and formation particles in central bore 89 of fluid admitting member 18 to be pulled rearwardly within central bore 89 and causes a relatively small formation fluid sample to be pulled through fluid line 88 into pre-test fluid sample chamber 87. The predetermined pressure threshold which unseats relief valve 66 is selected to be of a threshold which will assure that before formation fluids are taken into formation admitting member 18 for pre-test that both well engaging pad member 17 and fluid admitting member 18 are fully extended to and establish firm contact with the wall of the borehold, and that the leading portion of fluid admitting member 18 penetrates through any mud cakes on the wall of the borehole.

The rearward movement of displacement piston 86 within pre-test sample assembly 70 pulls any mud cakes and formation particles lodged within central bore 89 rearwardly within central bore 89. The rearwardly movement of mud cakes and formation particles within central bore 89 opens a number of forwardly located lateral fluid passages connecting central bore 89 to a number of coaxial fluid passages 91, placing passages 91 into fluid communication through fluid line 92 to formation pressure sensor 93, equalizer valve 73, and to sample pressure control valve 99. Formation pressure sensor 93 is preferably a strain gage functioning as an electrical resistance bridge. Formation fluid pressures alter the electrical resistance, imbalancing the electrical bridge producing an output voltage signal representative of the formation pressures. The formation pressure sensor 93 output signal is transmitted to the surface control unit. Illustrated in FIG. 3 is a graphic representation of the typical output signal from formation pressure sensor 93. As instrument 13 is located within a borehole formation pressure sensor output, interval A indicates a measurement of the hydrostatic pressure within the borehole. Shown by interval B, the signal will indicate an initial pressure drop as fluids intake into pre-test sample assembly 70, with a subsequent increase and leveling off to a stable pressure valve. Interval C of the curve of FIG. 3, indicating the initial shut-in pressure of connote fluids, if any, present within the pretested earth formations.

As previously discussed, an instrument 13 is lowered within a borehole hydrostatic pressure acting on isolation piston 22 produces a counterbalancing pressure in the hydraulic fluid in the power system. This hydraulic fluid, at hydrostatic pressure, is coupled by means of divider valve 76 into hydraulic line 108 and into chamber 107 of pressure restrictor valve 99, hydraulic line 111 and fluid chamber 112 of balance valve 113. The application of PF pressure unseats relief valve 66, allowing hydraulic fluid flow into fluid chamber 69 of pre-test sample assembly 70, further allows hydraulic fluid flow through branch hydraulic line 71 to fluid chamber 72 of equalizer valve 73, solenoid valve 80, solenoid valve 81, solenoid valve 82 and solenoid valve 83. The PF hydraulic fluid pressure flow into fluid chamber 72 of equalizer valve 73 moves the valve piston 94 thereby isolating fluid line 95 and branch line 96. Further, the application of PF pressure shifts piston 106 of divider valve 76 thereby isolating hydraulic fluid at hydrostatic pressure within hydraulic lines 108 and 111 and fluid chambers 107 and 112. Additionally, the application PF pressure shifts piston 78 of valve 79 rearwardly into chamber 90 thereby expanding chamber 122 thus reducing the pressure in hydraulic lines 120 and 123. The trapped pressurized hydraulic fluid exerts a force upon piston 119 further exerting a force upon ball 117, shifting ball 117 into a sealing state within fluid cavity 98, thereby isolating fluid line 96 from fluid line 102.

To collect a formation sample, an electrical command signal is transmitted to solenoid valve 83 which shifts the valve piston within solenoid valve 83 opening a PF hydraulic fluid path through hydraulic line 127 to first sample storage tank control valve 105 shifting the piston in this valve, creating a path for formation fluids to flow from the exit of fluid cavity 98 through fluid lines 102 and 103 and passing through fluid line 129, through first sample storage tank lock valve 128, which is a normally open lock valve, through fluid line 135 and into fluid sample storage chamber 141 of first sample storage tank 134. Normally hydrostatic pressure exceeds formation pressures. Therefore, ball seal 117 will normally isolate formation fluid sample line 96 from line 102 due to hydraulic fluids trapped at hydrostatic pressure biasing piston 119 and ball 117 into a sealing position. When an electrical signal is applied to solenoid valve 109, typically by means of a surface control, the piston within solenoid valve 109 shifts thereby allowing hydraulic fluid to flow from hydraulic line 108 into hydraulic line 120 through flow restrictor 121, acting as a resistance to such flow, into hydraulic line 123 and into fluid chamber 122 of valve 79. By selectively operating solenoid valve 109 the pressurized fluid within fluid chamber 107 is controllably released, thus lowering the biasing force exerted on piston 119 and ball seal 117. Lowering of the biasing pressures in cavity 107 allow the formation fluid pressures to be able to overcome the biasing on ball seal 117 caused by the hydraulic fluid pressures within fluid chamber 107. Additionally, it will be noted that movement of piston 11.9 into fluid chamber 107 displaces hydraulic fluids from chamber 107 into fluid chamber 112 of balance valve 113 moving piston 114 into cavity 116.

Referring again to FIG. 3, interval D indicates the opening of a sample storage tank control valve 105 and pressure restrictor valve 99. It should be appreciated that whereas the curve of FIG. 3 clearly indicates a drop in fluid pressure while the sample tanks are filled, this drop is controlled by means of solenoid valve 109 to be significantly less than the pressure drops encounterd without sample line pressure control as provided by sample pressure control valve 99. Thus, by controllably reducing the differential pressure between borehole hydrostatic pressure and pressure in the formation fluid sample line when a sample tank at or near atmospheric pressure is opened there is reduced the possibility of packer seal loss while collecting a sample.

When a suitable sample has been accumulated in sample storage chamber 141 an electrical command signal is transmitted to solenoid valve 82 opening a PF hydraulic fluid path through hydraulic line 133 to first sample storage tank lock valve 128 shifting the valve piston blocking the fluid path to first sample storage tank 134, with the collected fluid sample retained therein. In a similar manner, a fluid sample is collected and retained within second sample storage tank 137 by electrical command signals to solenoid valves 81 and 80. The pressure curve at interval E of FIG. 3 illustrates the final shut-in pressure of the formation as measured by formation pressure transducer 93.

Formation fluids entering fluid sample storage chamber 141 or fluid sample storage chamber 142 at their formation zone pressures moves the respective floating piston 139 or 140 toward the bottom of first sample storage tank 134 of second sample storage tank 137, respectively. The downward movement of floating piston 139 or 140 displaces fluid, such as water, contained within the appropriate water reservoir 143 or 144. Water is returned to water cushion tank 149 through flow control orifice 147 or 145 at a steady, predictable rate established by the size of the orifice. A more complete description of the water cushion system can be found in the aforementioned U.S. Pat. No. 3,011,554, which has been incorporated herein by reference.

When it is determined by the pre-test that the earth formations are unsuited for testing or when a formation sample has been obtained electrical command signals are transmitted to dump valve 41 and valve assembly 32, opening dump valve 41 through hydraulic line 42 into hydraulic fluid chamber 21 and shifting the piston in fluid chamber 31 of valve assembly 32 thereby opening hydraulic line 48 into fluid chamber 31 and sealing hydraulic line 36 therefrom. With valve assembly 32 in this position, rotation of hydraulic pump 26 provides pump reverse pressure flow (PR). Hydraulic pump 26 draws fluid from hydraulic fluid chamber 21 through hydraulic line 29, filter 28, and hydraulic line 27 into hydraulic pump 26 further being pumped through hydraulic line 30 into fluid chamber 31 of valve assembly 32. The pressurized hydraulic fluid passes through hydraulic line 48 and unseats check valve 49 entering hydraulic line 51 and flowing into pressure regulating valve 50. Pressure regulating valve 50 allows the PR flow pressure to peak preferably between 1700 and 1750 psi before unseating and opening a return line through hydraulic line 52 into hydraulic fluid chamber 21. Hydraulic pressure is coupled also to first check valve section 37 of dual pilot check valve 38 for sealing purposes to prevent fluid bleed-back therethrough.

The PR hydraulic fluid flow passes from pressure regulating valve 90 through hydraulic line 54 into piston retractor chamber 53. From piston retractor chamber 53 hydraulic fluid pressure passes through hydraulic line 59 into fluid admitting member retractor chamber 60 further passing through hydraulic line 61 into piston retractor chamber 62. The PR hydraulic flow moves pistons 63 and 64 rearwardly retracting well engaging pad member 17 from contact with the borehole wall. On the opposite side of the sampling and measuring instrument 13 the PR hydraulic pressure flow telescopically retracts fluid admitting member 18. Moving from piston retractor chamber 62 through hydraulic line 84 hydraulic fluid flows into fluid chamber 85 of pre-test sample assembly 70 pushing displacement piston 86 forward. This movement of displacement piston 86 forces formation fluids within fluid chamber 87 through fluid line 88 and central bore 89 of fluid admitting member 18, forcing any mud cakes and formation particles in central bore 89 to be displaced and pushed into the borehole. Hydraulic fluid from fluid chamber 69 is displaced through check valve 67 into the PF hydraulic line system back into hydraulic fluid chamber 21.

When hydraulic pump 26 operates to create PR hydraulic fluid flow piston 96 of equalizer valve 94 shifts. In this valve position a borehole fluid path is provided through fluid line 97 into fluid lines 95 and 96 and coaxial fluid passage 91 returning to the borehole. The pressure of the borehole fluid flow counteracts the pressure exerted externally on fluid admitting member 18 by the borehole fluids and aids the PR pressure flow in retracting fluid admitting member 18. The borehole fluid flow also serves to clean any formation particles from coaxial fluid passages 91. PR hydraulic fluid pressure flow further shifts piston 106 of divider valve 76 reopening a fluid path between hydraulic fluid line 74 and hydraulic fluid lines 110 and 108 thereby allowing any pressurized fluids remaining in fluid chamber 107, hydraulic fluid line 111 and fluid chamber 112 to be vented into hydraulic fluid reservoir 21. Additionally, PR hydraulic fluid flow shifts piston 79 of valve 79 forward displacing any hydraulic fluid contained within chamber 122 through check valve 77 to be returned to fluid reservoir 21.

Many modifications and variations besides those specifically illustrated may be made in the techniques and structures described herein without departing substantially from the concept of the present invention. Accordingly, it should be understood that the forms of the invention described and illustrated herein are exemplary only, and are not intended as limitations on the scope of the present invention.

The embodiments of the invention in which an exclusive property or privilege is claimed are defined as follows:

1. Fluid sampling apparatus for obtaining samples of connate fluids from subsurface earth formations traversed by a borehole comprising:

a body member adapted for suspension in a borehole;

a fluid sampling probe cooperatively arranged on and extensible from said body member;

a sample collection means cooperatively arranged on said body member for receiving and retaining a sample of connate fluids;

a fluid passage coupled between said fluid sampling probe and said sample collection means; and control means located in said fluid passage intermediate said fluid sampling probe and said sample collection means for controlling the flow pressure within at least a portion of said fluid passage at a selected level, said level proportional function of hydrostatic pressure, wherein said pressure control means comprises;

means for receiving and retaining a quantity of fluids at hydrostatic pressure; and pressure responsive means for restricting said fluid passage in proportional response to the pressure of said fluids sample retained in said receiving and retaining means.

2. The fluid sampling apparatus of claim 1, wherein said sample collection means comprises:

fluid sample storage means for receiving and retaining said fluid sample; and selectively operable control means for fluidly communicating and isolating said fluid passage with said fluid sample storage means.

3. The fluid sampling apparatus of claim 1, further comprising control value means for selectively controlling the quantity of said fluids in said receiving and retaining means.

4. The fluid sampling apparatus of claim 3, further comprising pressure measuring means cooperatively arranged on said body member for providing electrical signals representative of the pressure of said connate fluids.

5. Apparatus for collecting samples of the fluid content of earth formations traversed by a borehole, comprising:

an elongated body member adapted to traverse a borehole;

first sample collecting means cooperatively arranged on said body member for receiving a first sample of said fluid content;

second sample collecting means cooperatively arranged on said body member for receiving a second sample of said fluid content;

a selectively extensible and retractable fluid sampling probe cooperatively arranged on said body member;

fluid passage means coupled between said probe and said first and said second sample collection means; and control means located in said fluid passage means intermediate said probe and said second sample collecting means for controlling the flow pressure within at least a portion of said fluid passage means at a pressure level proportional function of hydrostatic pressure of said borehole, wherein said control means comprises;

fluid collecting means for receiving a fluid sample at hydrostatic pressure; and means for restricting fluid communication between said probe and second sample collecting means in response to the pressure of said fluid sample.

6. The sample collecting apparatus of claim 5, further comprising hydraulic power means for extending and retracting said probe.

7. The sample collecting apparatus of claim 5, wherein said first sample collecting means comprises:

selectively expansible fluid sample storage means for receiving and retaining said first fluid sample; and pressure sensitive means for expanding said storage means at a predetermined hydraulic fluid pressure generated by said hydraulic power means.

8. The sample collecting apparatus of claim 7, wherein said second collecting means comprises:

fluid sample storage means for receiving and retaining said second fluid sample;

first selectively operable valve means for fluidly connecting said fluid sample storage means with said fluid passage means; and second selectively operable valve means for fluidly isolating said fluid sample storage means from said fluid passage menas.

9. The sample collecting apparatus of claim 5, further comprising control valve means for selectively controlling the quantity of said fluids in said fluid collecting means.

10. The sample collecting apparatus of claim 9, further comprising pressure measuring means for providing electrical signals representative of said formations.

11. The sample collecting apparatus of claim 10, further comprising pressure measuring means for providing electrical signals representative of the hydraulic fluid of said hydraulic power means.

12. Apparatus for collecting samples of the fluid content of earth formations traversed by a borehole, said apparatus including an elongated body member adapted to traverse said borehole, comprising:

fluid sample collecting means cooperatively arranged on said body member for receiving a sample of said fluid content;

probe means cooperatively arranged on said body member for fluidly connecting said body member with said earth formations;

a fluid passage connecting said probe means with said sample collecting means; and means for controlling the flow pressure level within said fluid passage to at least a predetermined proportional relation to hydrostatic pressure.

13. The sample collecting apparatus of claim 12, wherein said pressure level maintaining means comprises:

a hydraulic fluid sample collection chamber for collecting fluid samples at hydrostatic pressure;

a selectively operable valve for isolating said hydraulic fluid sample chamber; and pressure responsive means for restricting fluid flow within said fluid passage in proportion to the pressure of said hydraulic fluid within said hydraulic fluid sample collection chamber.

14. The sample collecting apparatus of claim 4, further comprising an electrically controllable valve for selectively controlling the pressure exerted by said pressure responsive means.

15. The sample collection apparatus of claim 14, wherein said pressure response means comprises:

sealing means for restricting said fluid passage; and biasing means for exerting sealing pressure on said sealing means in proportional relation to the pressure of said hydraulic fluid sample within said hydraulic fluid sample collection chamber.

16. The pressure response means of claim 15, further comprising expansion chamber means coupled to said fluid sample collection chamber for providing controlled displacement of said fluid sample contained therein.

* * * * *